US006551420B1

(12) United States Patent
Bergstrom et al.

(10) Patent No.: US 6,551,420 B1
(45) Date of Patent: Apr. 22, 2003

(54) DUPLEX STAINLESS STEEL

(75) Inventors: David S. Bergstrom, Natrona Heights, PA (US); John J. Dunn, Sarver, PA (US); John F. Grubb, Lower Burrell, PA (US); William A. Pratt, Butler, PA (US)

(73) Assignee: ATI Properties, Inc., Albany, OR (US)

( * ) Notice: Subject to any disclaimer, the term of this patent is extended or adjusted under 35 U.S.C. 154(b) by 0 days.

(21) Appl. No.: 09/981,074

(22) Filed: Oct. 16, 2001

(51) Int. Cl.[7] ..... C22C 38/44; C22C 38/54

(52) U.S. Cl. ..... 148/325; 148/607; 420/64; 420/65; 420/67

(58) Field of Search ..... 148/325, 327, 148/607; 420/59, 64, 65, 67

(56) References Cited

U.S. PATENT DOCUMENTS

| | | | | |
|---|---|---|---|---|
| 3,650,709 A | | 3/1972 | Morsing | |
| 4,340,432 A | | 7/1982 | Hede | |
| 4,798,635 A | | 1/1989 | Bernhardsson et al. | |
| 4,828,630 A | | 5/1989 | Daniels et al. | |
| 5,238,508 A | * | 8/1993 | Yoshitake et al. | 148/325 |
| 5,298,093 A | | 3/1994 | Okamoto | |
| 5,624,504 A | | 4/1997 | Miyakusu et al. | |
| 5,733,387 A | * | 3/1998 | Lee et al. | 148/325 |
| 6,096,441 A | | 8/2000 | Hauser et al. | |

FOREIGN PATENT DOCUMENTS

| | | | | |
|---|---|---|---|---|
| EP | 0 659 896 B1 | | 4/1997 | |
| EP | 1 061 151 A1 | | 12/2000 | |
| JP | 359211556 A | * | 11/1984 | C22C/38/54 |
| JP | 10-102206 | | 4/1998 | |

* cited by examiner

*Primary Examiner*—Deborah Yee
(74) *Attorney, Agent, or Firm*—Patrick J. Viccaro

(57) ABSTRACT

A duplex stainless steel including, in weight percent, up to 0.06 percent carbon, 15 up to less than 25 percent chromium, greater than 3 up to 6 percent nickel, up to 3.75 percent manganese, 0.14 up to 0.35 percent nitrogen, up to 2 percent silicon, greater than 1.4 up to less than 2.5 percent molybdenum, up to less than 0.5 percent copper, up to less than 0.2 percent cobalt, up to 0.05 percent phosphorous, up to 0.005 percent sulfur, and 0.001 up to 0.0035 percent boron, with the remainder being iron and incidental impurities is disclosed. The duplex stainless steel may be included in an article of manufacture, such as a strip, bar, plate, sheet, casting, tubing or piping. A method for making such a duplex stainless steel is also disclosed.

43 Claims, No Drawings

DUPLEX STAINLESS STEEL

BACKGROUND OF THE INVENTION

1. Field of the Invention

The present invention relates generally to a duplex stainless steel. In particular, the present invention relates to a duplex stainless steel that can be an economical alternative to certain known duplex stainless steels, while also providing improved corrosion resistance relative to certain austenitic stainless steels, such as the AISI Type 304, 316 and 317 austenitic stainless steels. The present invention is also directed to a method of manufacturing the duplex stainless steel of the invention. The duplex stainless steel of the present invention finds application in, for example, corrosive environments and may be fabricated into articles of manufacture, such as, for example, strip, bar, plate, sheet, casting, pipe or tube.

2. Description of the Invention

Duplex stainless steels are alloys that contain a microstructure consisting of a mixture of austenite, and ferrite phases. Generally, they exhibit certain characteristics of both phases, along with relatively higher strength and ductility. Various duplex stainless steels have been proposed, some of which are described in U.S. Pat. Nos. 3,650,709, 4,340,432, 4,798,635, 4,828,630, 5,238,508, 5,298,093, 5,624,504, and 6,096,441.

Early duplex alloys had moderate resistance to general corrosion and chloride stress corrosion cracking, but suffered a substantial loss of properties when used in the as-welded condition. Presently, one of the most widely used second-generation duplex stainless steels is available under the trademark AL 2205 (UNS S31803 and/or S32205) from Allegheny Ludlum Corporation, Pittsburgh, Pa. This duplex stainless steel is a nominal 22% chromium, 5.5% nickel, 3% molybdenum, and 0.16% nitrogen alloy that provides corrosion resistance in many environments that is superior to the AISI Type 304, 316 and 317 austenitic stainless steels (Unless otherwise noted, all percentages herein are weight percentages of total alloy weight). AL 2205, which is a nitrogen-enhanced duplex stainless steel that imparts the metallurgical benefits of nitrogen to improve corrosion performance and as-welded properties, also exhibits a yield strength that is more than double that of conventional austenitic stainless steels. This duplex stainless steel is often used in the form of welded pipe or tubular components, as well as a formed and welded sheet product in environments where resistance to general corrosion and chloride stress corrosion cracking ("SCC") is important. The increased strength creates opportunities for reduction in tube wall thickness and resists handling damage.

As just indicated, AL 2205 has been widely accepted by tube and pipe end users, particularly as a low cost replacement to Type 316 stainless steel when SCC is a concern. This is due, in large part, to the fact that AL 2205 is significantly more resistant to crevice corrosion than the Type 316 and Type 317 austenitic stainless steels. This superior resistance to chloride-ion crevice corrosion is illustrated in the table below, which shows the results of ASTM Procedure G48B using a 10% ferric chloride solution. The 10% ferric chloride solution referred to is by weight for the hexahydrate salt and is equivalent to an approximately 6% by weight solution of the anhydrous ferric chloride salt.

Crevice Corrosion Data in 10% Ferric Chloride

| Alloy | Temperature of Onset of Crevice Corrosion |
|---|---|
| Type 316 | 27° F. (−3° C.) |
| Type 317 | 35° F. (2° C.) |
| AL 2205 | 68° F. (20° C.) |

However, the extraordinary corrosion resistance (and other properties) of AL 2205 may be greater than is required in some applications. In certain SCC applications, while AL 2205 would provide an acceptable technical solution, it may not be an economical replacement alloy for Type 304, 316 or 317 stainless steel. The higher cost of AL 2205 is due primarily to the amounts of the alloying elements nickel (nominal 5.5%) and molybdenum (nominal 3%).

Thus, it is desirable to provide a weldable, formable duplex stainless steel that has greater corrosion resistance than the Type 304, Type 316 or Type 317 austenitic stainless steels, and has a lower production cost than the commonly used AL 2205 duplex stainless steel.

SUMMARY OF THE INVENTION

The present invention relates to a duplex stainless steel comprising, in weight percent, up to 0.06 percent carbon; 15 up to less than 25 percent chromium; greater than 3 up to 6 percent nickel; up to 3.75 percent manganese; 0.14 up to 0.35 percent nitrogen; up to 2 percent silicon; greater than 1.4 up to less than 2.5 percent molybdenum; up to less than 0.5 percent copper; up to less than 0.2 percent cobalt; up to 0.05 percent phosphorous; up to 0.005 percent sulfur; 0.001 up to 0.0035 percent boron; and iron and incidental impurities. This duplex stainless steel is a weldable, formable steel that can exhibit greater corrosion resistance than Type 304, Type 316 and Type 317 austenitic stainless steels.

According to one particular embodiment of the present invention, the duplex stainless steel may comprise, in weight percent, up to 0.03 percent carbon; 19.5 up to 22.5 percent chromium; greater than 3 up to 4 percent nickel; up to 2 percent manganese; 0.14 up to 0.20 percent nitrogen; up to 1 percent silicon; 1.5 up to 2.0 percent molybdenum; up to 0.4 percent copper; up to 0.3 percent phosphorous; 0.001 percent sulfur; and 0.001 5 up to 0.0030 percent boron; iron and incidental impurities.

Also, the duplex stainless steel of the present invention may consist essentially of, in weight percent, up to 0.03 percent carbon; 19.5 up to 22.5 percent chromium; greater than 3 up to 4 percent nickel; up to 2 percent manganese; 0.14 up to 0.20 percent nitrogen; up to 1 percent silicon; 1.5 up to 2.0 percent molybdenum; up to 0.4 percent copper; up to 0.3 percent phosphorous; 0.001 percent sulfur; and 0.0015 up to 0.0030 percent boron; iron and incidental impurities.

The present invention also relates to articles of manufacture such as, for example, strips, bars, plates, sheets, castings, tubing, or piping fabricated from or including the duplex stainless steel of the present invention. The articles formed of the duplex stainless steels of the present invention may be particularly advantageous when intended for service in chloride containing environments.

In addition, the present invention relates to a method for making a duplex stainless steel. According to the method of the present invention, a duplex stainless steel is provided comprising up to 0.06 percent carbon; 15 up to less than 25 percent chromium; greater than 3 up to 6 percent nickel; up to 3.75 percent manganese; 0.14 up to 0.35 percent nitrogen; up to 2 percent silicon; greater than 1.4 up to less than 2.5 percent molybdenum; up to less than 0.5 percent copper; up to less than 0.2 percent cobalt; up to 0.05 percent phosphorous; up to 0.005 percent sulfur; 0.001 up to 0.0035 percent boron; iron and incidental impurities. The steel is solution annealed and cooled. The steel may be further processed to an article of manufacture or into any other desired form.

DETAILED DESCRIPTION OF THE INVENTION

The present invention relates to a duplex stainless steel comprising, in weight percent, up to 0.06 percent carbon; 15 up to less than 25 percent chromium; greater than 3 up to 6 percent nickel; up to 3.75 percent manganese; 0.14 up to 0.35 percent nitrogen; up to 2 percent silicon; greater than 1.4 up to less than 2.5 percent molybdenum; up to less than 0.5 percent copper; up to less than 0.2 percent cobalt; up to 0.05 percent phosphorous; up to 0.005 percent sulfur; 0.001 up to 0.0035 percent boron; iron and incidental impurities. The foregoing duplex stainless steel of the present invention preferably contains each of the austenite and ferrite phases, in the range of between 20% and 80% by volume in the annealed condition. The duplex stainless steel of the invention is a weldable, formable material that may exhibit greater corrosion resistance than Type 304, Type 316 and Type 317 austenitic stainless steels.

According to certain embodiments of the present invention, the duplex stainless steel may comprise, in weight percent, up to 0.03 percent carbon; 19.5 up to 22.5 percent chromium; 3 up to 4 percent nickel; up to 2 percent manganese; 0.14 up to 0.20 percent nitrogen; up to 1 percent silicon; 1.5 up to 2.0 percent molybdenum; up to 0.4 percent copper; up to 0.3 percent phosphorous; 0.001 percent sulfur; and/or 0.0015 up to 0.0030 percent boron; iron and incidental impurities. These ranges may be particularly well suited for tubing uses that require both formability and strength, while maintaining required levels of corrosion resistance. The duplex stainless steel of the present invention may include various other alloying additions and additives as are known in the art. Thus, embodiments of the duplex stainless steel of the present invention may be less costly to produce than the commonly used AL 2205 duplex stainless steel because of a lower content of alloying additions, particularly nickel and molybdenum. Nevertheless, the duplex stainless steel of the present invention still provides a stable austenite phase (with respect to deformation-induced martensite) and the desired level of corrosion resistance. Below, the nickel and molybdenum content of certain embodiments of the present invention are compared to AL 2205.

Amounts Of Elements Ni and Mo (In Weight Percent)

| Alloy | Embodiments of the Duplex Alloy of the Present Invention | AL 2205 |
|---|---|---|
| Ni | Greater than 3.0 to 4.0 | 5.5% nominal |
| Mo | 1.5 to 2.0 | 3% nominal |

Despite the reduced level of nickel and molybdenum compared to AL 2205, evaluated embodiments of the duplex stainless steel of the present invention exhibit pitting/crevice corrosion resistance that is significantly greater than Type 304, 316 and 317 austenitic stainless steels. As is known in the art, the Type 316 and 317 stainless steels are more resistant to pitting/crevice corrosion than Type 304 stainless steel.

As an example of the present invention, the present inventors produced a heat of a duplex stainless steel containing, in weight percent, 0.018% carbon, 0.46% manganese, 0.022% phosphorous, 0.0034% sulfur, 0.45% silicon, 20.18% chromium, 3.24% nickel, 1.84% molybdenum, 0.21% copper, 0.166% nitrogen, and 0.0016% boron (hereinafter "Example 1"). As is illustrated below, this embodiment of the duplex stainless steel of the present invention exhibits significantly greater resistance to pitting corrosion than Type 316 and 317 austenitic stainless steels, while, due to the reduced nickel and molybdenum content, maintaining a lower production cost as compared to AL 2205.

Pitting Corrosion Resistance

| Alloy | Critical Pitting Temperature ("CPT") |
|---|---|
| Type 316 Stainless Steel | 59° F. (15.0° C.) |
| Type 317 Stainless Steel | 66° F. (18.9° C.) |
| Example 1 | 88.3° F. (31.3° C.) |

The CPT of Type 316 and 317 austenitic stainless steels is based on ASTM procedure G-48A. According to this procedure, a sample of the material is immersed in a beaker containing a 6% solution of ferric chloride for 72 hours at the desired temperature and then evaluated for signs of pitting. By repeating the test at increasing temperatures, the temperature at which pitting initiates can be determined. The CPT of Example 1 was measured by ASTM procedure G150. According to this procedure, the same value, CPT, determined by ASTM procedure G-48A is determined by placing a sample of the material in an electrochemical cell containing 1 molar (approximately 5.8% by weight) sodium chloride solution and polarized to a potential of +700 mV vs. SCE. The temperature of the solution is increased at the rate of 1° C. per minute, and the corrosion current is monitored. At some temperature the current increases rapidly and exceeds a 100 microamps per square centimeter threshold. This temperature is recorded as the CPT. Pitting on the specimen is then visually confirmed.

In addition, the present inventors also developed another duplex stainless steel within the present invention, containing, in weight percent, 0.021% carbon, 0.50% manganese, 0.022% phosphorous, 0.0014% sulfur, 0.44% silicon, 20.25% chromium, 3.27% nickel, 1.80% molybdenum, 0.21% copper, 0.167% nitrogen, and 0.0016% boron (hereinafter "Example 2") was produced and various mechanical properties of the steel were evaluated. The results are illustrated below. As expected, the mechanical properties of Example 2 exceeded the minimum requirements of ASTM specification A240 for AL 2205. Moreover, although the yield and tensile strengths for Example 2 were lower than AL 2205, they are comparable. Importantly, however, these values were substantially greater than the minimum strength requirements of ASTM specification A 240 for Type 304, 316, and 317 austenitic stainless steels.

| Standard or Alloy | Mechanical Properties 0.2% Offset Yield Strength | Ultimate Tensile Strength | % Elongation |
|---|---|---|---|
| ASTM A 240 Minimum 304 Stainless Steel | 30,000 | 75,000 | 40.0 |
| ASTM A 240 Minimum 316 Stainless Steel | 30,000 | 75,000 | 40.0 |
| ASTM A 240 Minimum 317 Stainless Steel | 30,000 | 75,000 | 35.0 |
| ASTM A 240 Minimum AL 2205 Duplex Stainless Steel | 65,000 | 90,000 | 25 |
| AL 2205 Stainless Steel | 85,000 | 125,000 | 30 |
| Example 2 | 83,500 | 114,000 | 37 |

Thus, the duplex stainless steel of the present invention may provide a lower cost alternative to AL 2205. As illustrated by Examples 1 and 2 of the present invention, embodiments of the duplex stainless steel of the present invention exhibit mechanical properties comparable to AL 2205 along with resistance to pitting/crevice corrosion that is significantly greater than the Type 316 and 317 stainless steels.

The present invention also relates to articles of manufacture such as, for example, strips, bars, plates, sheets, castings, tubing, or piping composed of or including the duplex stainless steel of the present invention. According to these embodiments of the present invention, the article of manufacture is composed of or includes a duplex stainless steel comprising, in weight percent, up to 0.06 percent carbon; 15 up to less than 25 percent chromium; greater than 3 up to 6 percent nickel; up to 3.75 percent manganese; 0.14 up to 0.35 percent nitrogen; up to 2 percent silicon; greater than 1.4 up to less than 2.5 percent molybdenum; up to less than 0.5 percent copper; up to less than 0.2 percent cobalt; up to 0.05 percent phosphorous; up to 0.005 percent sulfur; and 0.001 up to 0.0035 percent boron; iron and incidental impurities. The articles formed of the duplex stainless steel of the present invention may be particularly advantageous for service in chloride containing environments.

In addition, the present invention relates to a method for making a duplex stainless steel. According to the method of the present invention, a duplex stainless steel is provided comprising, in weight percent, up to 0.06 percent carbon; 15 up to less than 25 percent chromium; greater than 3 up to 6 percent nickel; up to 3.75 percent manganese; 0.14 up to 0.35 percent nitrogen; up to 2 percent silicon; greater than 1.4 up to less than 2.5 percent molybdenum; up to less than 0.5 percent copper; up to less than 0.2 percent cobalt; up to 0.05 percent phosphorous; up to 0.005 percent sulfur; and 0.001 up to 0.0035 percent boron; iron and incidental impurities. According to the method, the steel is subsequently solution annealed and then cooled. The steel may be further processed using techniques known to those of ordinary skill in the art to an article of manufacture, such as those mentioned above, or into any other desired form.

It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with only certain embodiments, those of ordinary skill in the art will, upon considering the foregoing description, recognize that many embodiments, modifications, and variations of the invention may be made. All such variations and modifications of the invention are covered by the foregoing description and the following claims.

We claim:

1. A duplex stainless steel comprising, in weight percent: up to 0.06 percent carbon; 15 up to 22.5 percent chromium; greater than 3 up to less than 4 percent nickel; up to 3.75 percent manganese; 0.14 up to 0.35 percent nitrogen; up to 2 percent silicon; greater than 1.4 up to less than 2.5 percent molybdenum; up to less than 0.5 percent copper; up to less than 0.2 percent cobalt; up to 0.05 percent phosphorous; up to 0.005 percent sulfur; 0.001 up to 0.0035 percent boron; iron and incidental impurities.

2. The duplex stainless steel of claim 1 comprising up to 0.03 percent carbon.

3. The duplex stainless steel of claim 1 comprising 15 up to less than 21 percent chromium.

4. The duplex stainless steel of claim 1 comprising greater than 3 up to 3.5 percent nickel.

5. The duplex stainless steel of claim 1 comprising up to 2 percent manganese.

6. The duplex stainless steel of claim 1 comprising 0.14 up to 0.20 percent nitrogen.

7. The duplex stainless steel of claim 1 comprising up to 1 percent silicon.

8. The duplex stainless steel of claim 1 comprising 1.5 up to 2.0 percent molybdenum.

9. The duplex stainless steel of claim 1 comprising up to 0.4 percent copper.

10. The duplex stainless steel of claim 1 comprising up to 0.03 percent phosphorous.

11. The duplex stainless steel of claim 1 comprising up to 0.001 percent sulfur.

12. The duplex stainless steel of claim 1 comprising 0.0015 up to 0.003 percent boron.

13. The duplex stainless steel of claim 1 wherein the steel is weldable and formable.

14. A duplex stainless steel consisting essentially of, in weight percent: up to 0.06 percent carbon; 15 up to 22.5 percent chromium; greater than 3 up to less than 4 percent nickel; up to 3.75 percent manganese; 0.14 up to 0.35 percent nitrogen; up to 2 percent silicon; greater than 1.4 up to less than 2.5 percent molybdenum; up to less than 0.5 percent copper; up to less than 0.2 percent cobalt; up to 0.05 percent phosphorous; up to 0.005 percent sulfur; 0.001 up to 0.0035 percent boron; iron and incidental impurities.

15. A duplex stainless steel comprising, in weight percent: up to 0.03 percent carbon; 15 up to less than 21 percent chromium; greater than 3 up to less than 4 percent nickel; up to 2 percent manganese; 0.14 up to 0.20 percent nitrogen; up to 1 percent silicon; 1.5 up to 2 percent molybdenum; less than 0.4 percent copper; less than 0.2 percent cobalt; up to 0.03 percent phosphorous; 0.001 up to 0.0035 percent boron; iron and incidental impurities.

16. An article of manufacture including a duplex stainless steel comprising, in weight percent up to 0.06 percent carbon, 15 up to 22.5 percent chromium, greater than 3 up to less than 4 percent nickel, up to 3.75 percent manganese, 0.14 up to 0.35 percent nitrogen, up to 2 percent silicon, greater than 1.4 up to less than 2.5 percent molybdenum, up to less than 0.5 percent copper, up to less than 0.2 percent cobalt, up to 0.05 percent phosphorous, up to 0.005 percent sulfur, 0.001 up to 0.0035 percent boron; iron and incidental impurities.

17. The article of claim 16 wherein said steel is in the form of an article selected from the group consisting of strip, bar, plate, sheet, casting, tubing and piping.

18. A method for making a duplex stainless steel, the process comprising:

providing a duplex stainless steel alloy comprising, in weight percent, up to 0.06 percent carbon, 15 up to 22.5 percent chromium, greater than 3 up to less than 4 percent nickel, up to 3.75 percent manganese, 0.14 up to 0.35 percent nitrogen, up to 2 percent silicon, greater than 1.4 up to less than 2.5 percent molybdenum, up to less than 0.5 percent copper, up to less than 0.2 percent cobalt, up to 0.05 percent phosphorous, up to 0.005 percent sulfur, 0.001 up to 0.0035 percent boron; iron and incidental impurities;

solution annealing the steel; and cooling the steel.

19. The duplex stainless steel of claim 3 comprising 15 up to 20.5 weight percent chromium.

20. The duplex stainless steel of claim 3 comprising greater than 3 up to 3.5 weight percent nickel.

21. The duplex stainless steel of claim 1 wherein the steel includes no more than an incidental amount of tungsten.

22. The duplex stainless steel of claim 14 consisting essentially of 15 up to less than 21 weight percent chromium.

23. The duplex stainless steel of claim 22 consisting essentially of 15 up to 20.5 weight percent chromium.

24. The duplex stainless steel of claim 14 consisting essentially of greater than 3 up to 3.5 weight percent nickel.

25. The duplex stainless steel of claim 22 consisting essentially of greater than 3 up to 3.5 weight percent nickel.

26. The duplex stainless steel of claim 14 consisting essentially of up to 0.4 weight percent copper.

27. The duplex stainless steel of claim 15 comprising 15 up to 20.5 weight percent chromium.

28. The duplex stainless steel of claim 15 comprising greater than 3 up to 3.5 weight percent nickel.

29. The duplex stainless steel of claim 27 comprising greater than 3 up to 3.5 weight percent nickel.

30. The duplex stainless steel of claim 15 comprising up to 0.4 weight percent copper.

31. The duplex stainless steel of claim 15 wherein the steel includes no more than an incidental amount of tungsten.

32. The article of manufacture of claim 16 wherein said duplex stainless steel comprises 15 up to less than 21 weight percent chromium.

33. The article of manufacture of claim 32 wherein said duplex stainless steel comprises 15 up to 20.5 weight percent chromium.

34. The article of manufacture of claim 16 wherein said duplex stainless steel comprises greater than 3 up to 3.5 weight percent nickel.

35. The article of manufacture of claim 32 wherein said duplex stainless steel comprises greater than 3 up to 3.5 weight percent nickel.

36. The article of manufacture of claim 16 wherein said duplex stainless steel comprises up to 0.4 weight percent copper.

37. The article of manufacture of claim 16 wherein said duplex stainless steel comprises no more than an incidental amount of tungsten.

38. The method of claim 18 wherein said duplex stainless steel comprises 15 up to less than 21 weight percent chromium.

39. The method of claim 38 wherein said duplex stainless steel comprises 15 up to 20.5 weight percent chromium.

40. The method of claim 18 wherein said duplex stainless steel comprises 3 up to 3.5 weight percent nickel.

41. The method of claim 38 wherein said duplex stainless steel comprises 3 up to 3.5 weight percent nickel.

42. The method of claim 18 wherein said duplex stainless steel comprises up to 0.4 weight percent copper.

43. The method of claim 18 wherein said duplex stainless steel includes no more than an incidental amount of tungsten.

* * * * *